United States Patent [19]

Lane

[11] Patent Number: 4,554,881

[45] Date of Patent: Nov. 26, 1985

[54] TRAPEZE SYSTEM

[75] Inventor: Leonard A. Lane, Lennox Heads, Australia

[73] Assignee: Illirrie Holdings Pty Ltd., Australia

[21] Appl. No.: 441,533

[22] PCT Filed: Mar. 3, 1982

[86] PCT No.: PCT/AU82/00021

§ 371 Date: Oct. 27, 1982

§ 102(e) Date: Oct. 27, 1982

[87] PCT Pub. No.: WO82/03051

PCT Pub. Date: Sep. 16, 1982

[30] Foreign Application Priority Data

Mar. 3, 1981 [AU] Australia ..... PE7818

[51] Int. Cl.[4] ..... B63H 9/08

[52] U.S. Cl. ..... 114/39; 114/90

[58] Field of Search ..... 114/253, 97, 39.1, 39.2, 114/89, 90; 440/33, 34; 441/106-119; 182/3-9, 231-234; 272/61, 62, 110, 111, 112

[56] References Cited

U.S. PATENT DOCUMENTS

| | | | |
|---|---|---|---|
| 2,364,578 | 12/1944 | Wilkie | 114/39 |
| 3,217,833 | 11/1965 | Smith | 182/3 |
| 3,716,232 | 2/1973 | Johnson et al. | 272/62 |
| 3,837,642 | 9/1974 | Martin | 272/62 |
| 3,985,090 | 10/1976 | Rineman | 114/39 |
| 4,418,631 | 12/1983 | Frohbach | 114/39 |

FOREIGN PATENT DOCUMENTS

| | | | |
|---|---|---|---|
| 2345172 | 10/1977 | France | 114/39 |
| 2366988 | 6/1978 | France | 114/39 |
| 2457212 | 1/1981 | France | 114/39 |
| 7903765 | 11/1980 | Netherlands | 114/39 |
| 1227230 | 4/1971 | United Kingdom | 441/69 |

*Primary Examiner*—Trygve M. Blix
*Assistant Examiner*—Stephen P. Avila
*Attorney, Agent, or Firm*—Darby & Darby

[57] ABSTRACT

A trapeze system is adapted for use on a sailing vessel having a substantially vertical mast. The trapeze system comprises a pair of substantially rigid hanging members connected at their upper extremities to an upper extremity of a mast in such a manner that each hanging member is capable of movement on its respective side of the mast. A trapeze harness is provided, together with a hook for releasably connecting the hanging members to the trapeze harness.

14 Claims, 9 Drawing Figures

TRAPEZE SYSTEM

BACKGROUND OF THE INVENTION

The invention relates to sailing craft and in particular to a system of sailor location.

The system subject of the invention may be compared by analogy with "trapeze systems" currently in use in relation to sailing craft although provides advantages to a sailor not normally attributable to a conventional "trapeze system". It is the object of the present invention to facilitate location of a sailor's body in various controlled and stable relationships to a sailing craft during all aspects of normal sailing and additionally wave jumping and "gliding".

In order that the sails of small unbalasted or lightly balasted craft sailing "close hauled" with respect to the wind may generate a horizontal forward (with respect to the craft's hull) motive force an undesirable heeling moment is generated about the fore aft axis of the hull, such force acting to capsize the vessel unless counteracted by an equal and opposite righting moment.

It has been the practice for many years to provide the equal and opposite righting moment abovementioned by utilising the weight of one or more sailors aboard the craft at points to the windward side of the fore aft axis of the craft and preferably outboard of the hull. In order that a sailor may locate his body weight at a point outboard of the crafts hull according to conventional means the sailor is provided with a harness about the wearer's torso releasably connected to a "trapeze" wire suspended from a point upon the upper regions of the mast of the craft. The length of such trapeze wire is adjusted so as to maintain the users torso above sea level with the vessel in a substantially upright position, the users feet resting upon the gunwale of the vessel and the users body almost entirely outboard of the hull.

Conventional dingy type hulls display considerable inherent "form" stability due to a relatively high beam/-length ratios and such high beam/length ratio hull additionally affords a sailor the capability of placing his body weight at a considerable distance from the longitudinal centre line of the boat but not outboard of the gunwale thereby providing a considerable righting moment without utilising a trapeze system or other system designed to facilitate the placement of the sailors entire bodyweight outboard of the gunwale. Even when a trapeze system is provided with the conventional "dingy" hull having the aforementioned comparatively high beam/length ratio the trapeze system is relatively simple to master as the "form" stability of such hulls prevents capsize when an inexperienced sailor using a trapeze is a little late in swinging inboard of the the gunwale in a lull or places his bodyweight in a position on the hull other than in very close proximity to the centreline of such hull.

Board type sailing craft having low beam/length ratio hulls have recently become popular in conjunction with non-stayed masts mounted upon some type of universal joint at the junction of the mast and hull. The movable unstayed masts of such vessels are adapted to fall into non-perpendicular relationship to the hull should the sailor misjudge the necessary trim of the sail dictated by prevailing wind conditions thereby preventing what would be a capsize in a vessel with a stayed mast or mast otherwise secured in a perpendicular relationship to the hull. Such vessels as last described with moveable masts, commonly described as "sailboards", additionally permit movement of the board out of a substantially horizontal alignment with the water without necessarily altering mast and hence sail trim and this feature renders such craft forgiving in so far as placement of a sailor's body weight in respect of a hull/board having little "form" stability.

The advantages of fast manoeuvreable low beam/-length ratio board type hulls are difficult to exploit in conjunction with the advantages of a conventional fixed and stayed mast rig due to the fact that, in order to counteract the heeling moment of the sail the sailor's body weight must be capable of being placed outboard of the gunwale thereby dictating some type of trapeze system.

Trapeze systems presently available provide no location or hand holds for the trapeze user whilst outboard of the hull except in so far as such systems prevent movement of the trapeze user into an area defined by the outside of an arc subtended about the point of attachment of the trapeze wire to the mast by a straight line equal to the length of the trapeze wire. In short conventional trapeze systems do not provide an infinite variety of handholds to the user whilst outboard of the hull and furthermore provide no location for the user in respect of movement in an upwards or inwards direction relative to the gunwale on the trapezer's side of the hull. The aforementioned defect of presently existing wire trapeze systems making learning to sail low beam/-length ratio board type hulled craft with fixed masts displaying the aforementioned lack of form stability extremely difficult, particularly for beginners as for example in choppy waters a person trapezing outboard of the gunwale of such craft is often thrown upwards and/or inwards with respect to the gunwale on the user's side of the craft.

After a sailor has "tacked" when utilising a conventional trapeze system there is a period of instability when assuming the correct position upon the new windward side of the craft as the degree of righting moment required of the sailor changes rapidly from nil, when the boat is head to wind to a considerable degree when the craft has once again gained speed and is correctly trimmed on the new tack. The degree of righting moment required at any instant during the lastmentioned tacking process may change rapidly with the alteration of sail trim and is not necessarily progressive. This requires a trapezer to vary his position with respect to the longitudinal centre line of the boat quickly and a number of times whilst setting the boat up on the new tack. The lastmentioned adjustments to trapezing position must be accomplished whilst the sailor is attaching himself to the new windward side trapeze system and furthermore whilst manipulating controls. Conventional trapeze systems are not well adapted to serve the sailor in such conditions as they are difficult to "hook into" due to the flexible nature of "wire" systems which often require two hands to ensure connection of the wire system to the trapeze harness hook and furthermore due to the fact that manipulation of one segment of a wire does not result in accurate control of another section of such wire. Wires additionally do not provide an infinite variety of convenient hand holds due to their extremely small diameter.

SUMMARY OF THE INVENTION

The aforementioned disadvantages of conventional trapeze systems have been overcome according to the present invention whilst simultaneously providing other advantages to the user. According to the present invention there is provided, in place of conventional trapeze wires, a pair of substantially rigid trapeze hangers connected at their upper ends, to a point on points in proximity to the mast's upper end and adapted at their lower ends to releasably engage a hook or other securing means on trapeze belt. Such rigid trapeze hangers, which inevitably are of larger section or radius than conventional trapeze wires, provide an infinite variety of handholds for the trapeze user and additionally restrain the trapeze user in a far more positive manner than conventional trapeze wires. Such positive location may additionally be enhanced by the utilisation of conventional footloops affixed to the hull. It may be appreciated that a trapeze hanger in accordance with the present invention may be accurately manipulated so as to bring same into the desired relationship with a trapeze harness hook by grabbing the hanger at any convenient position as manipulation of one part of the hanger will result in predictable movement of any other portion of such rigid member. One may additionally swing one's body outboard during the tacking and/or "hooking up" procedure above described supporting one's by an infinite variety of handholds thereby facilitating precise control of the necessary "righting moment" during the tacking procedure and at all other times.

Although the trapeze hangers can be used without being interconnected at their lower extremities, the trapeze hangers may be rendered of greater utility by the connection of the lower extremity of one trapeze hanger to the lower extremity of the opposite trapeze hanger in such a fashion that the lower extremeties of both trapeze hangers are maintained in a predetermined spaced relationship from each other and substantially behind the mast of the vessel in a position for convenient utilisation of a sailor about to adopt or in a trapezing position. The hanger connecting/spacing means last referred to shall hereinafter be referred to as the trapeze bar. It should be appreciated that a system in accordance with the present invention as above described provides an additional advantage over conventional trapeze systems in so far as the trapeze "hangers" extend in a vertical axis to a position below the boom and mainsail but not to deck level. The absence of a connection at deck level facilitates the provision of a less cluttered "gunwale"—an important consideration in small craft where sailors are required to move along the gunwale to assist in boat trim and through the very small space below the boom and deck level during tacking.

It will be appreciated that the trapeze bar will come into contact with the base of the mast if it is attempted to swing both trapeze hangers forward of the mast when the bar is initially set up behind the mast. It should be appreciated however that the inclusion of a trapeze bar as lastmentioned may result in the leaward hanger coming into undesirable contact with the leaward side of the sail or boom when the opposite hanger is being utilised at a point outward from the gunwale, such contact being undesirable in so far as the trim of the sail may be altered. It is for this reason that the trapeze bar in accordance with the present invention may be provided with the facility to part at some point along its length. The two independant sections of the trapeze hanger bar system thereby created are biased so as to re-adopt a unitary appearance with continuous unbroken bar when not being acted upon by any substantial force. The biasing means lastmentioned may comprise a length of elastic cord spanning the predetermined "parting/breaking" point aforementioned and being connected at either end in such a manner as not to facilitate infinite movement of one half of a trapeze hanger/bar system with respect to the other.

It should be appreciated that the above described trapeze system may be utilized in conjunction with "wishbone" type booms or conventional type booms in conjunction with all conventional fore aft rig sailing vessels with stayed masts. The advantages of the present trapeze system are equally applicable to conventional high beam/length ratio hulls as to low beam/length ratio hulls of the board type. In order to achieve the abovementioned objects the hangers provided may be substantially straight or be provided with a gentle curve so as to avoid contact with the sail or boom. Alternatively shaped trapeze hangers may be utilized to provide the additional advantage of the present invention hereafter.

It has been determined that a trapeze system in accordance with the present invention may provide a greater righting moment than a trapeze wire when the trapeze hanger is provided in such a shape that the entire hanger, when in its normal alignment with the boat and rig, remains outboard of an imaginary line drawn from the upper extremity of the hanger to the lower extremity of the hanger.

As above described the trapeze system in accordance with the present invention must be adapted so as to be connectible to substantially conventional trapeze harnesses or trapeze harness hooks, the trapeze harness being the means by which the trapeze user's body is restrained and located by the trapeze system. Such releasable connection between the trapeze system and trapeze harness or hook may be in accordance with a variety of existing methods and in particular a ring or multiplicity of rings may be provided at a point or points along the trapeze hangers or bar into which a conventional trapeze harness hook may be placed thereby securing the trapeze harness wearer to the trapeze system.

It is further envisaged that a ring may be provided in such a manner as to be slideable up and down the trapeze hangers and across the trapeze bar (and further across a length of shock cord when the trapeze bar is parted as above described). In this manner a trapeze user may "tack" from one side of the trapeze system to the other without unhooking himself from the said ring about the trapeze system which ring during the tacking procedure may slide from one hanger across the trapeze bar (and shock cord if the bar is separated) to the desired point at the base of or upon the opposite trapeze hanger. Means may additionally be provided upon the trapeze hangers for location of the aforementioned ring at various positions other than at the base of the trapeze hanger.

It has been found that, in order for the two parts of the trapeze bar (resulting from a bar provided with a parting point) to re-assume a continuous linear relationship when biased to such relationship by an elastic cord in the absence of other forces it is advantageous to provide one side of the partable bar with a section at its free end of lesser external diameter than the internal diameter of the opposite bar so as to facilitate a length over which the bars may telescope; hence ensuring linear alignment of the bar when in the unitary position. It has been found that while tubular aluminium is suitable for most of the trapeze system subject of the present invention such material is not suitable for use in respect of the lastmentioned telescoping parts and therefore the two sections adapted to telescope into each other should be manufactured of a plastic material to avoid binding. The free end of the bar incorporating the male telescoping section may additionally be provided with a "lead-in-cone" to facilitate perfect alignment of the male and female telescoping members before telescoping occurs. The maximum diameter of the cone is that external diameter of the male telescoping member and the apex of the cone is provided with an aperture through which the aforementioned biasing elastic cord may freely pass. The plastic female section of the telescoping tubing provided at the free end of the opposite bar to that last referred to may be of identical diameter to the remainder of that bar hanger section and may be secured in linear relationship thereto by utilisation of an internal ferrule riveted in place. The lastmentioned ferrule facilitates manufacture of the hangers and part of the bar of aluminium tubing whilst ensuring that the telescoping members may still be manufactured of plastic material.

BRIEF DESCRIPTION OF THE DRAWING

A number of embodiments of the present invention will now be described with reference to the annexed drawings.

DESCRIPTION OF THE PREFERRED EMBODIMENT

Figure 1:
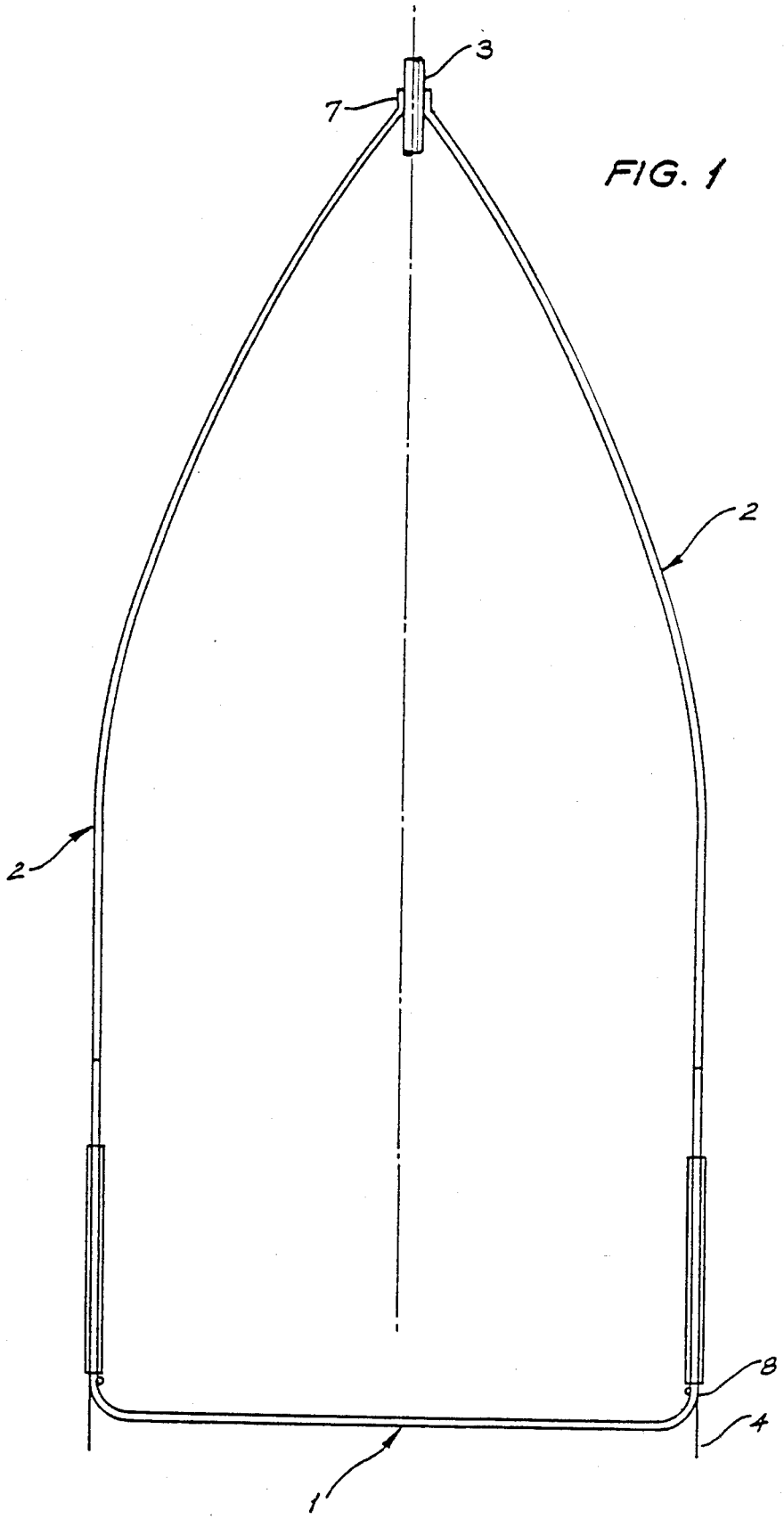
Figure 4:
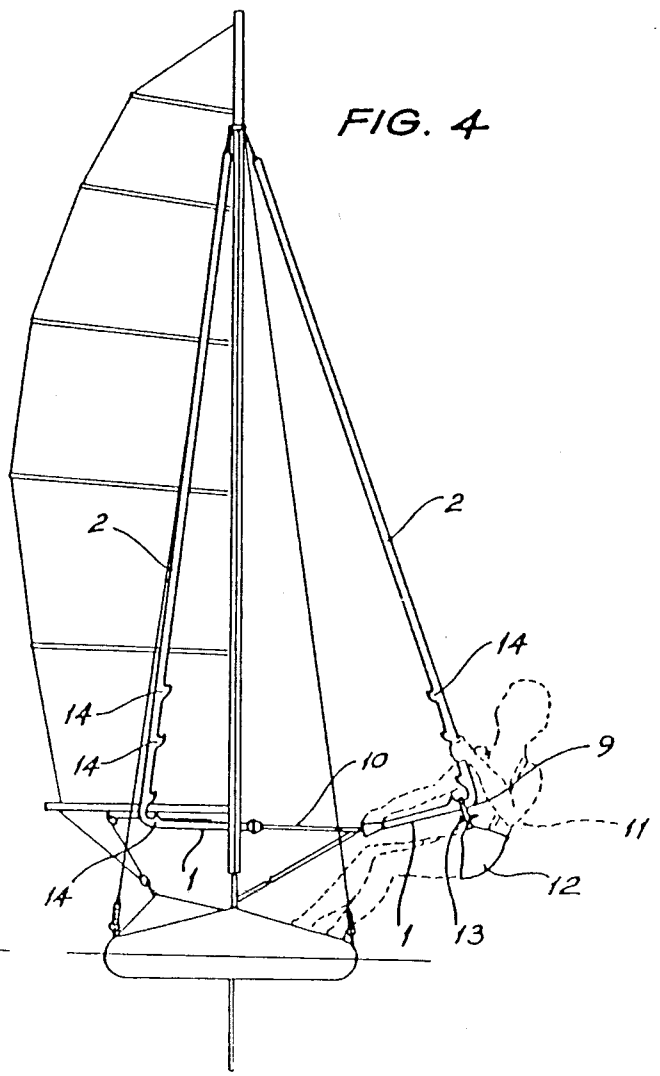
Figure 3:
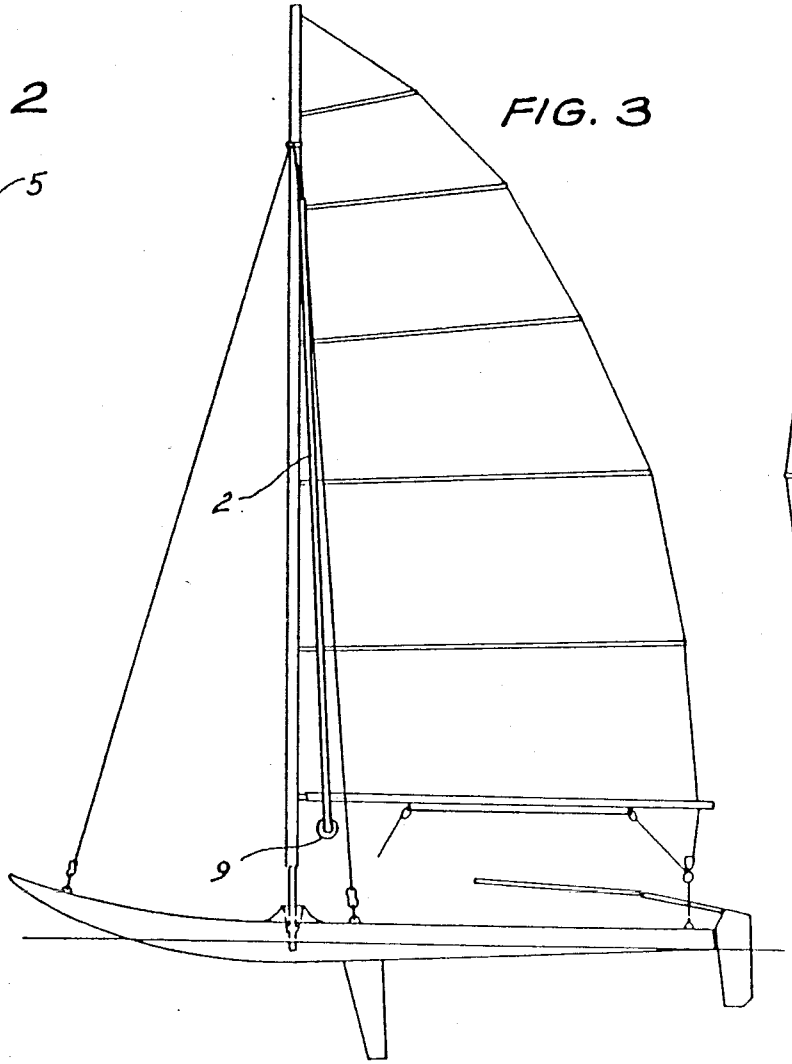
Figure 2:
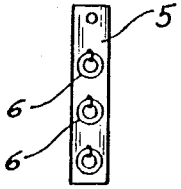
Figure 5:
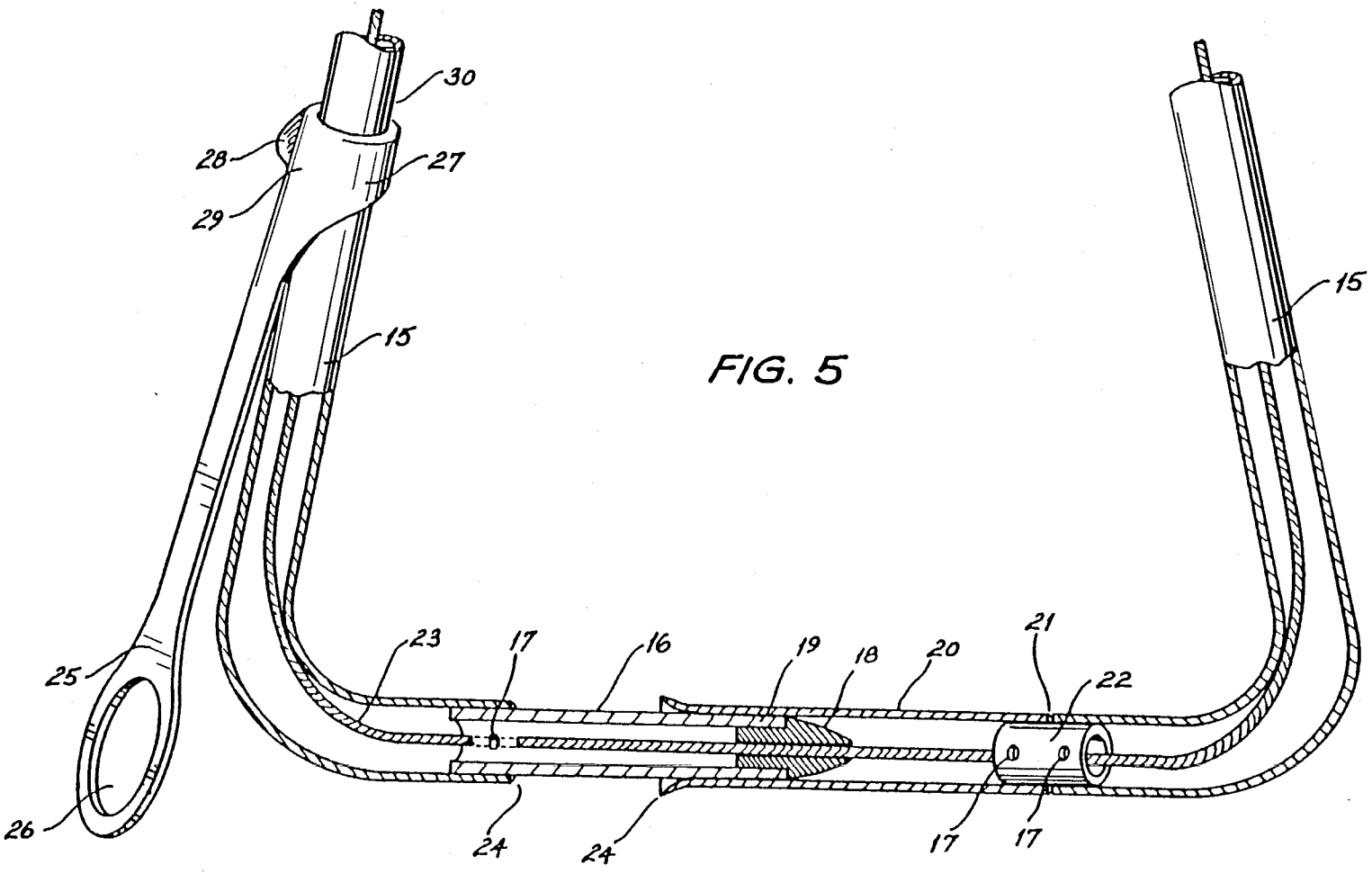
Figure 6:
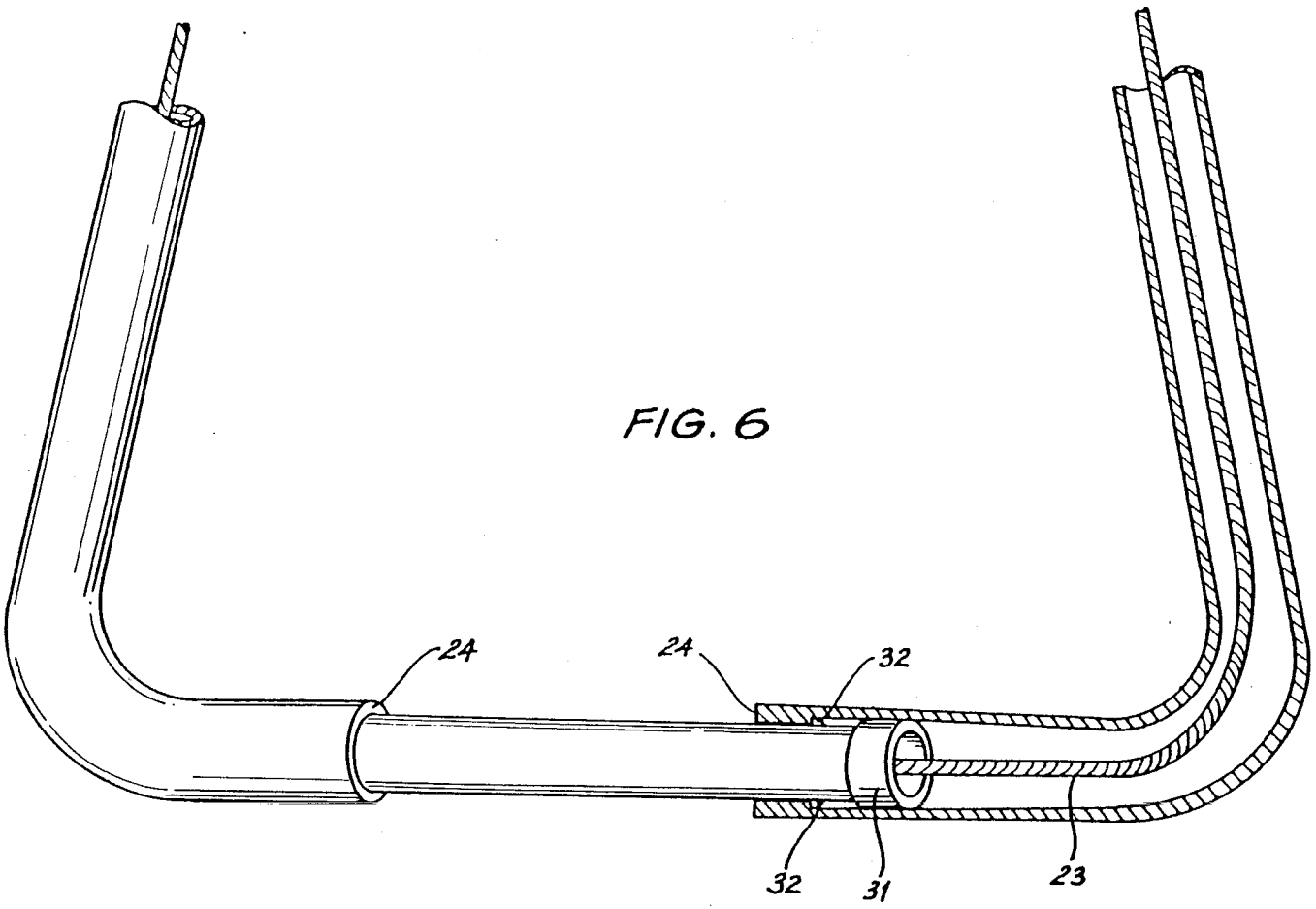
Figure 7:
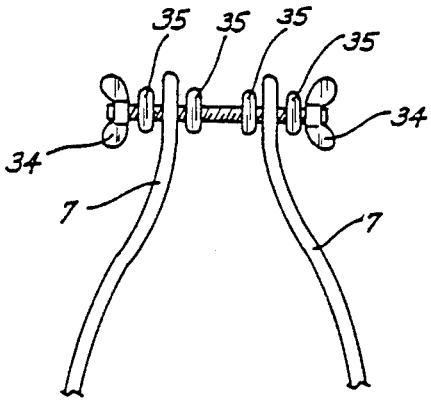
Figure 8:
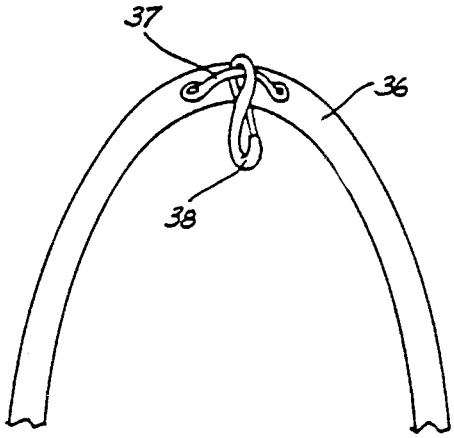
Figure 9:
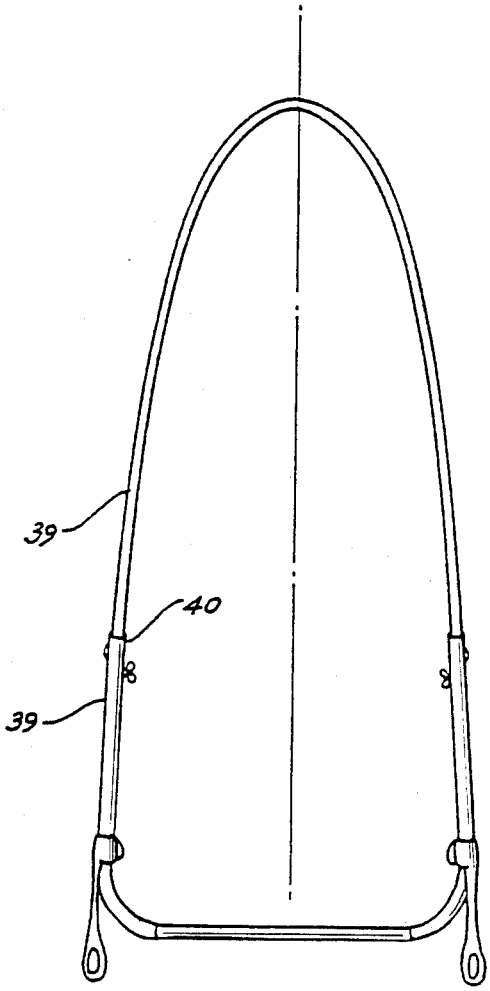

FIG. 1 is an end elevation of one embodiment of a trapeze system in accordance with the present invention;

FIG. 2 is a side elevation of a portion of the apparatus of FIG. 1;

FIG. 3 is a side elevation of a sailing craft provided with a trapeze system in accordance with the present invention;

FIG. 4 is a front elevation of a sailing craft provided with a trapeze system in accordance with the present invention;

FIG. 5 is a view on a larger scale and partly in longitudinal section of a portion of a trapeze bar constructed in accordance with the invention;

FIG. 6 is a view similar to FIG. 5 showing an alternative embodiment of a trapeze bar constructed in accordance with the invention;

FIG. 7 is an elevational view of the upper extremity of one embodiment of a trapeze system according to the invention;

FIG. 8 is an elevational view of the upper extremity of another embodiment of a trapeze system according to the invention; and FIG. 9 is an end elevation showing a complete trapeze system in accordance with the modification shown in FIG. 8.

FIG. 1 is an end elevation of a trapeze system in accordance with the present invention wherein a trapeze hanger system is depicted which includes a trapeze bar (1) and hangers (2), although it is envisioned that the hangers 2 may be used without an interconnection device such as bar 1, whereby the bar is connected to a mast (3) which components may all be manufactured of aluminium tubing of a diameter sufficient to facilitate gripping by the human hand and to provide adequate rigidity without excessive windage. The system depicted in FIG. 1 is provided with retention means designated by the reference (4) which comprise a webbing strap (5) (FIG. 2) to which steel rings (6) are secured and into which a trapeze hook (not shown) may be placed and thereby secured. The system depicted in FIG. 1 utilises trapeze hangers with free upper ends (7). The tubing is flattened adjacent the ends (7) to facilitate the attachment of the ends to the mast (3).

FIG. 2 is a side elevation showing the webbing incorporating the steel rings abovementioned which webbing is depicted in place upon the trapeze system in FIG. 1 at position (8).

FIG. 3 is a side elevation of a sailing craft illustrating the trapeze system subject of the present invention. FIG. 3 illustrates a trapeze hanger (2) and a ring (9) adapted to engage a trapeze harness hook which ring is further adapted to be slideable along the entire trapeze system.

FIG. 4 is a front view of a sailing craft illustrating a trapeze system in accordance with the present invention. FIG. 4 illustrates trapeze hangers (2) with integral two part trapeze bar (1) which two part trapeze bar is joined by a length of elastic cord (10). One side of the trapeze system is in use by a sailor (11) in a trapeze harness (12) attached to a trapeze hook (13) which trapeze hook is engaged by a ring (9). Means (14) are depicted whereby the ring may be retained at a number of points along the trapeze bar and hangers.

FIG. 5 is an enlarged view of the trapeze bar showing part of the trapeze hanging members of the trapeze systems of the present invention. The system in accordance with FIG. 4 is manufactured of aluminium tubing (15) (FIG. 5) however incorporating plastic tubing in the section of the bar intended to telescope. There is provided a section of plastic tubing (16) of lesser diameter than the main aluminium hanger/bar material (15) which is secured to one hanger/bar section by rivets (17) the external diameter of the male plastic section (16) being roughly equal to the internal diameter of the aluminium tubing utilised in relation to the hangers. The male plastic section is adapted to have a cone (18) secured to its free end (19) so as to facilitate alignment with female telescoping plastic section (20) which section is in turn provided of equal diameter to the aluminium tubing (15) in order that same may be affixed in linear relationship to the section of the bar affixed to the opposite hanger than that to which in the male telescoping plastic section is affixed. The female telescoping section is affixed in relationship to its hanger/bar at point (21) by means of a ferrule (22) secured by rivets (17). The entire system is provided with a shock cord (23) passing through the centre of all tubular sections and the aforementioned cone, positively affixed at its free ends (not shown) and tensioned in such a manner as to cause points (24) to meet when the system is not being acted upon by any substantial force. FIG. 5 additionally depicts trapeze harness hook engagement means (25) fabricated of stiff webbing incorporating an aperture (26) into which a trapeze hook may be placed and thereby secured and further secured to a hanger by means of a belt (27). The inner surface of the belt is provided with "velcro" material (28) adapted to adhere to the outer surface of such belt (29) (also provided with velcro material) and further adapted to adhere to velcro material provided on the exterior surface of the trapeze hanger (30). It should be appreciated that the provision of velcro material as lastmentioned facilitates movement of the trapeze hook attachment means up and down the hanger to various desired positions and further facilitates tightening of the belt so as to provide additional strength with respect to the method of attachment of the webbing to the trapeze hanger.

FIG. 6 is a modification of the trapeze bar as illustrated in FIG. 5. FIG. 6 depicts the lower section of a trapeze hanger/bar system in accordance with the present invention wherein the end of the male telescoping member is provided with an external collar (31) adapted to abut with an internal collar inside the end of the female telescoping member (32) in such a manner as to prevent extension of the telescoping section of the bar beyond a certain predetermined point. Utilisation of a system in accordance with FIG. 6 precludes the necessity for a "lead-in cone" (18) although elastic cord (23) is still provided to bias the bar into a contracted form and ensure abutment of points (24) when no such substantial force is acting upon the system.

FIG. 7 is a view showing details of one method of attachment of the upper extremeties of the trapeze hangers (7) in accordance with the present invention to a mast (not shown) by means of a bolt (33), wing nuts (34) and rubber or nylon washers/shock rings (35).

FIG. 8 is a modification of the connection illustrated in FIG. 7 that may only be utilised in relation to trapeze hangers without a bar or with a fixed non telescoping bar. FIG. 8 depicts the upper regions of hangers in accordance with one embodiment of the present invention in a unitary and joined relationship (36). Such system may be utilised with or without a bar and attachment of the system to the mast (not shown) may be provided by utilising a saddle fitting (37) in conjunction with lashing (not shown) or in conjunction with a shackle (38) intended to engage a fitting provided upon the mast (not shown).

FIG. 9 is an end elevation illustrating a complete trapeze system in accordance with the modification illustrated in FIG. 8. FIG. 9 further depicts adjustable length telescoping hangers (39), the telescoping and adjustment taking place at point (40). Such system would have the capability of being stored and transported in a disassembled form being considerably more compact than a system utilising hangers of unitary construction. The claims defining the invention are as follows:

I claim:

1. A trapeze system adapted for use on a sailing vessel having a substantially vertical mast, such trapeze system comprising a pair of substantially rigid hanging members connected at their upper extremities to an upper extremity of a mast in such a manner that the hanging members are respectively in port and starboard positions relative to the mast and each is capable of movement on its respective side of the mast, and means for releaseably connecting said hanging members to a trapeze harness.

2. A system according to claim 1 wherein the hanging members are joined adjacent their lower extremeties by a trapeze bar.

3. A system according to claim 1 or 2 wherein the trapeze hanging members are united at their upper extremeties to form a rigid unitary structure.

4. A system in accordance with claim 2 wherein said means for releasably connecting said hanging members comprises a trapeze harness hook and a ring slidable along the trapeze bar and engageable by said hook.

5. A trapeze system in accordance with claim 1 wherein the hanging members are so shaped that each hanging member, when in its normal alignment with the craft and rig, remains outboard of an imaginary line from the upper extremity of such hanging member to the lower extremity thereof.

6. A trapeze system in accordance with claim 1 wherein the hanging members are constructed of tubular aluminium.

7. A trapeze system adapted for use on a sailing vessel having a substantially vertical mast, the trapeze system comprising:

a pair of substantially rigid hanging members connected at their upper extremities to an upper extremity of a mast in such a manner that each hanging member is capable of movement on its respective side of the mast;

means for releasably connecting said hanging members to a trapeze harness; and a trapeze bar joining the hanging members adjacent their lower extremities, the trapeze bar being formed in two parts which are interconnected and including flexible means for biasing the two parts of the trapeze bar into an end abutting relationship.

8. A system as claimed in claim 7 wherein said flexible means is an elastic cord.

9. A system in accordance with claim 7 wherein the two parts of the bar are in telescoping relationship with each other.

10. A system in accordance with claim 9 wherein the parts of the bar in telescoping relationship are manufactured of tubular plastic material.

11. A system according to claim 9 wherein the means are provided to limit the telescoping movement of the two parts.

12. A system in accordance with any of claim 7 or claims 8–11 wherein said means for releasably connecting said hanging members comprises a trapeze harness hook and a ring slidable along the trapeze bar and engageable by said hook.

13. A system in accordance with claim 16 wherein the ring is additionally slideable along at least a portion of the hanging members and the hanging members are formed with means to secure such ring in at least one fixed position.

14. A trapeze system adapted for use on a sailing vessel having a substantially vertical mast, the trapeze system comprising:

a pair of substantially rigid hanging members connected at their upper extremities to an upper extremity of a mast in such a manner that each hanging member is capable of movement on its respective side of the mast;

means for releasably connecting said hanging members to a trapeze harness; and a trapeze bar joining the hanging members adjacent their lower extremities, said means for releasably connecting said hanging members including a trapeze harness hook and a ring slidable along the trapeze bar and along at least a portion of the hanging members and engageable by said hook, the hanging members further including means to secure said ring in at least one fixed position.

* * * * *